US006086065A

United States Patent [19]

Svensson

[11] Patent Number: 6,086,065

[45] Date of Patent: Jul. 11, 2000

[54] APPARATUS FOR FEEDING SHEETS FROM A SHEET STORE

[75] Inventor: Lars Svensson, Flen, Sweden

[73] Assignee: De La Rue Cash Systems AB, Flen, Sweden

[21] Appl. No.: 09/039,377

[22] Filed: Mar. 16, 1998

[30] Foreign Application Priority Data

Mar. 20, 1997 [SE] Sweden ..... 9701025

[51] Int. Cl.[7] ..... B65H 39/10

[52] U.S. Cl. ..... 271/298; 271/305; 271/264; 271/267; 271/279; 271/300; 271/302; 414/357; 414/349; 414/350; 414/352; 186/37; 186/41; 186/53; 198/347.2; 198/349.1; 198/349; 198/367; 198/704; 198/706; 198/781.07; 198/791

[58] Field of Search ..... 271/305, 298, 271/264, 267, 279, 300, 302; 198/347.2, 349.1, 349, 367, 704, 706, 781.07, 791; 107/53, 54, 55, 47, 46, 23, 24.1; 186/37, 41, 53; 104/165, 130.01, 130.08

[56] References Cited

U.S. PATENT DOCUMENTS

| | | | |
|---|---|---|---|
| 517,702 | 4/1894 | Kurtz | 414/357 |
| 520,064 | 5/1894 | Leake | 104/130.08 |
| 618,858 | 2/1899 | Freeman | 198/367 |
| 729,752 | 6/1903 | Gates | 198/706 |
| 3,645,378 | 2/1972 | Jakubowski | 198/349 |
| 4,624,359 | 11/1986 | Gross | 198/468.6 |
| 4,998,860 | 3/1991 | Dehne | 414/750 |

FOREIGN PATENT DOCUMENTS

| | | | |
|---|---|---|---|
| 2 374 705 | 7/1978 | France . | |
| 2 601 343 | 1/1988 | France . | |
| 976991 | 6/1962 | United Kingdom | 109/55 |
| 2 146 824 | 4/1985 | United Kingdom . | |

*Primary Examiner*—Christopher P. Ellis
*Assistant Examiner*—Richard Ridley
*Attorney, Agent, or Firm*—Oliff & Berridge, PLC

[57] ABSTRACT

An arrangement for feeding sheets from a sheet store to either one of a plurality of stations includes a movable carriage which receives sheets fed from the store and which has driving cogwheels for coaction with a fixed cog railway outside the carriage.

The fixed cog railway includes a path selection slide that includes cog segments that can fit into the cog railway. The selector slide can be switched to either one of two possible positions by means of a processor-controlled, motor-driven arm.

7 Claims, 4 Drawing Sheets

APPARATUS FOR FEEDING SHEETS FROM A SHEET STORE

FIELD OF THE INVENTION

The present invention relates to apparatus for feeding sheets from a sheet store, for instance banknotes in a banknote dispenser, to any one of a plurality of dispensing stations and particularly of the kind comprising a movable carriage for transporting sheets dispensed from the sheet store and having driving cogwheels which coact with an essentially fixed cog railway outside the carriage.

DESCRIPTION OF THE PRIOR ART

There are known to the art apparatus of the aforementioned kind with which a carriage carrying an inwardly lying bundle of banknotes is able to move along three paths, namely:

1. From a home position, in which the banknotes are bundled, to a front dispensing opening;
2. From a home position to a rear dispensing opening; and
3. From a home position to a re-feed position from where the banknotes are later fed back to the banknote store in said apparatus.

The carriage is controlled with the aid of two path selectors and is driven by two cogwheels (preferably on each side), a main wheel and a slave wheel, coacting along a fixed cog railway in one of the side-walls of the arrangement, possibly in both side-walls. Path selection is effected with the aid of a switch arm with an integrated, triangular switch that guides the carriage in the right direction, said switch arm executing a circular movement.

The cog railway is broken at the triangular switch, i.e. the principal cog path is not a continuous cog rack where a change of path is to occur. Consequently, the main cogwheel that carries out the essential work in moving the carriage in meshing with the principal cog path, at the break in the cog railway, hands over the task of moving the carriage to the slave wheel which herewith grips into a small part of the cog railway positioned opposite the break in the principal cog path.

Because the two cogwheels rotate in different directions, a high degree of accuracy is required with respect to how and when they grip into and are released from their respective cog segments, since otherwise there is a serious risk that the two cogwheels will lock one another or fail to engage with the cog segment concerned. The performance of the apparatus is liable to be affected negatively in both cases.

SUMMARY OF THE INVENTION

In accordance with the present invention, apparatus for feeding sheets from a sheet store to any one of a plurality of stations comprises a movable carriage for transporting sheets dispensed from the store and having driving cogwheels which coact with a generally fixed cog railway located outside the carriage, the cog railway having a number of sections on to which the carriage can be selectively guided so as to move it to a selected one of the stations and is characterized in that the fixed cog railway includes at least one selector slide which is provided with cog segments that can be fitted into the cog railway and that can be switched to any one of at least two possible positions so as to connect selected sections of the cog railway and provide a substantially continuous cog path therebetween.

The invention eliminates the aforesaid drawbacks in that the fixed cog railway includes a path selection slide that includes cog segments that can be fitted into the cog railway and that can be moved to any one of the possible positions so as to create a substantially continuous cog rack path so that there is no break in the cog path.

BRIEF DESCRIPTION OF THE DRAWINGS

An example of the invention will now be described in more detail with reference to the accompanying schematic drawings, in which.

DETAILED DESCRIPTION OF THE EMBODIMENTS

Figure 1:
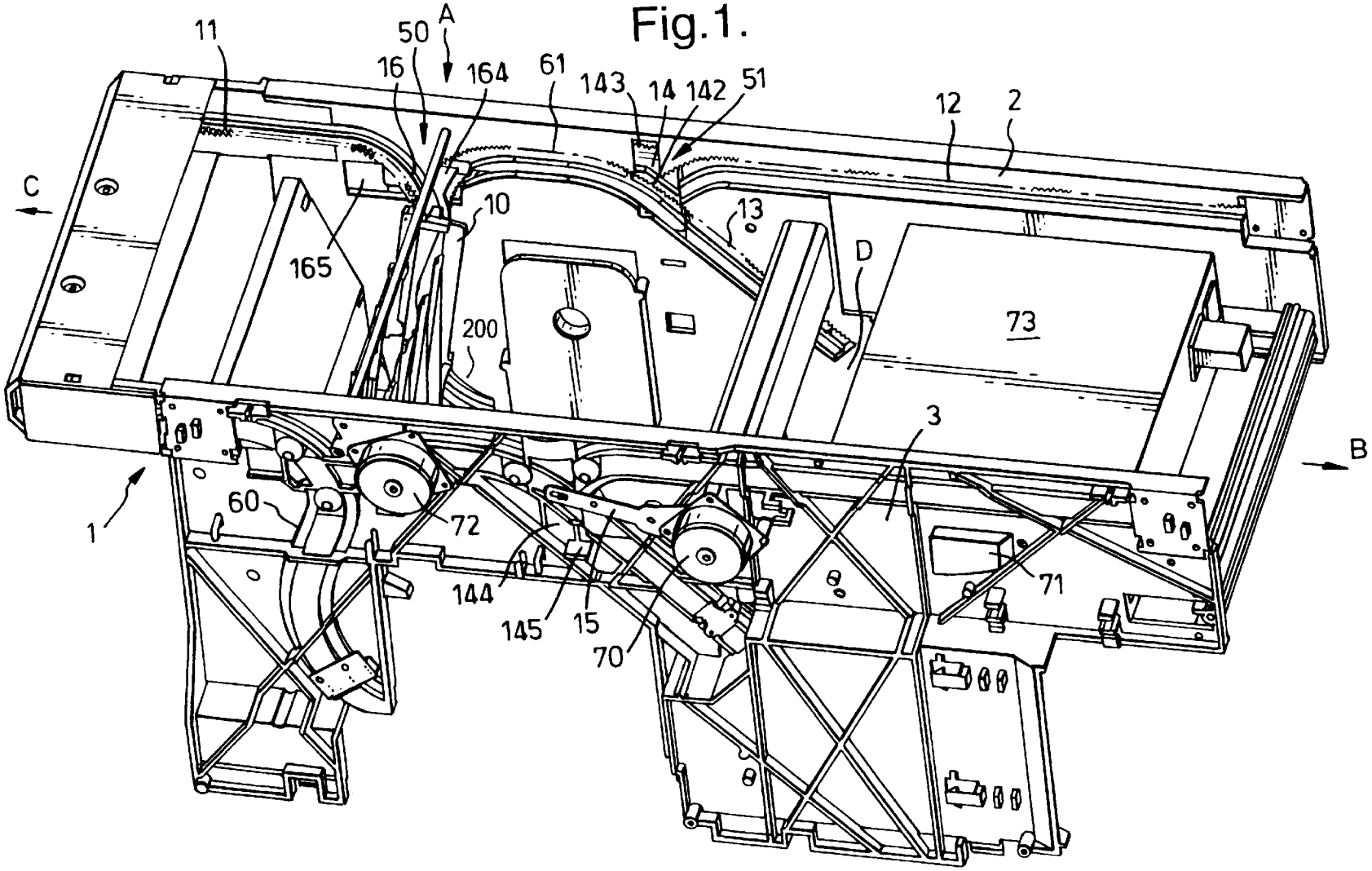
FIG. 1 illustrates the chassis of the apparatus that includes a carriage which can be guided from a starting position to any one of three stations.

FIG. 1 illustrates the chassis 1 of apparatus (a banknote dispenser) for feeding banknotes from a banknote store (indicated at A) to either one of three stations. The banknote store is located outside the chassis, and the three stations comprise a dispensing station B to the right of the Figure, a banknote dispensing station C to the left of the Figure and a reject station D located below and between said dispensing stations.

Figure 6:
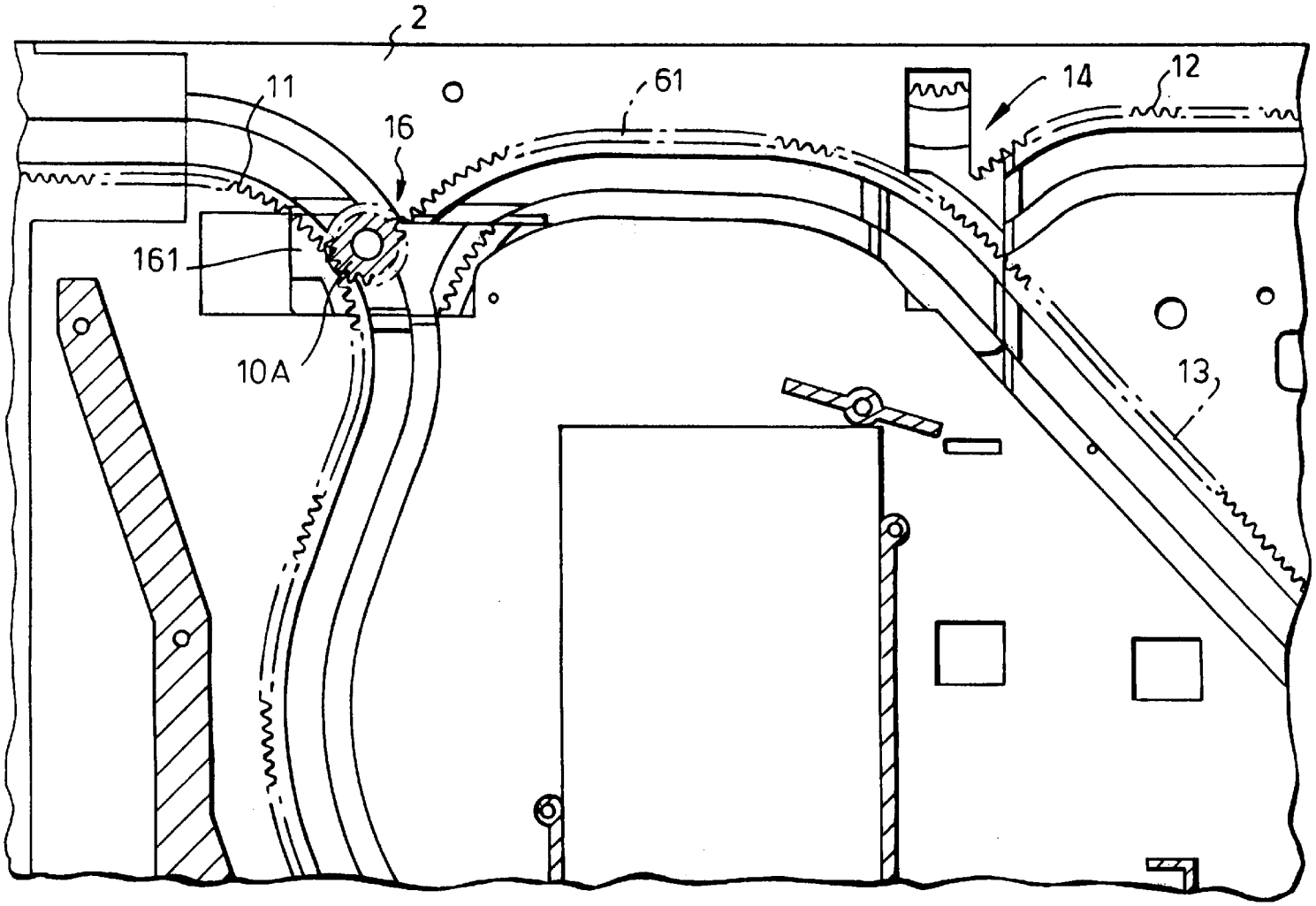

The apparatus includes a movable carriage 10 for transporting banknotes dispensed from the banknote store. The carriage includes driving cogwheels, one of which 10A is shown in FIG. 6, which are adapted to coact with a generally fixed cog railway 11-12-13-60-61 outside the carriage. The cog railway is fixed essentially along its full length and is comprised, in principle, of mutually identical cog racks or sections fixedly mounted in two plane-parallel side-walls 2,3 of the chassis 1. In the drawings, the racks mounted on the side-wall 2 farthest away from the viewer are clearly seen, with the rack 11 extending from a junction 50 to the dispensing station C, the rack 12 extending from a junction 51 to the dispensing station B, and the rack 13 extending from the junction 51 to the rejection station D. A rack 60 extends from the home position A to the junction 50 and a rack 61 interconnects the junctions 50,51. These racks thus coact with two cogwheels carried by the carriage 10 on the same axle, one cogwheel on each side of the carriage.

The fixed cog railway includes movable path selection slides 14,16 at the junctions 51,50. The slide 14 includes cog segments 142, 143 which can engage with the cog railway and which can be moved to either one of two possible positions 144, 145 by means of an arm 15 driven by a motor 70 under the control of a processor (not shown) located in a control unit 71. The processor is designed to control the entire banknote dispensing sequence from the banknote store A to a dispensing station chosen by a customer, e.g. station B. Power is provided from a supply 73.

Figure 2:
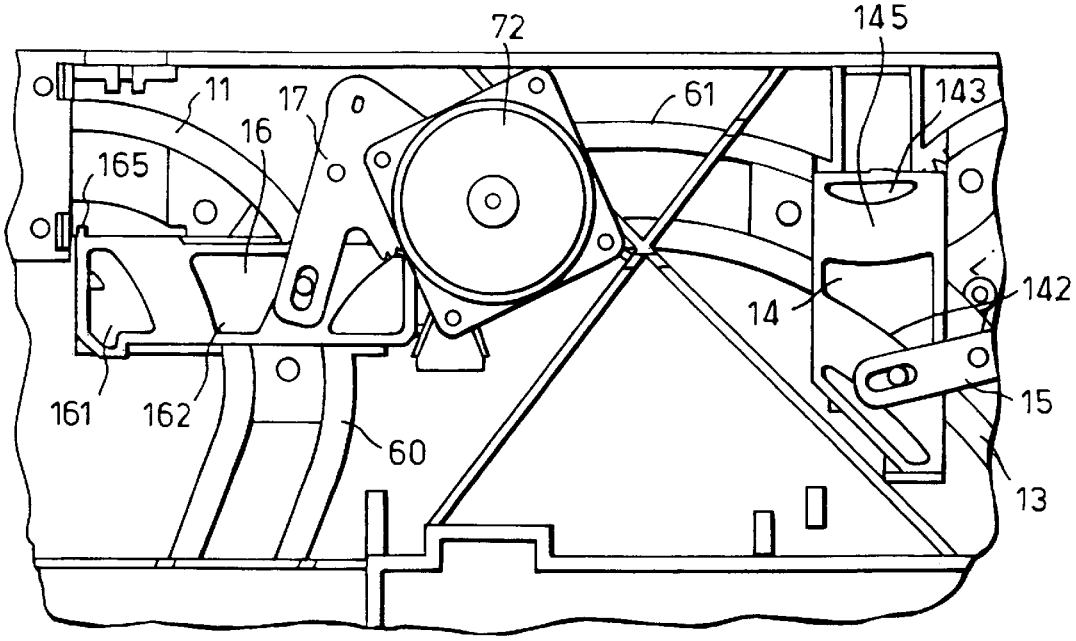
FIG. 2 is an external view of part of the apparatus shown in FIG. 1, and shows two selector slides in position for transporting a carriage to a dispensing station B.
Figure 3:
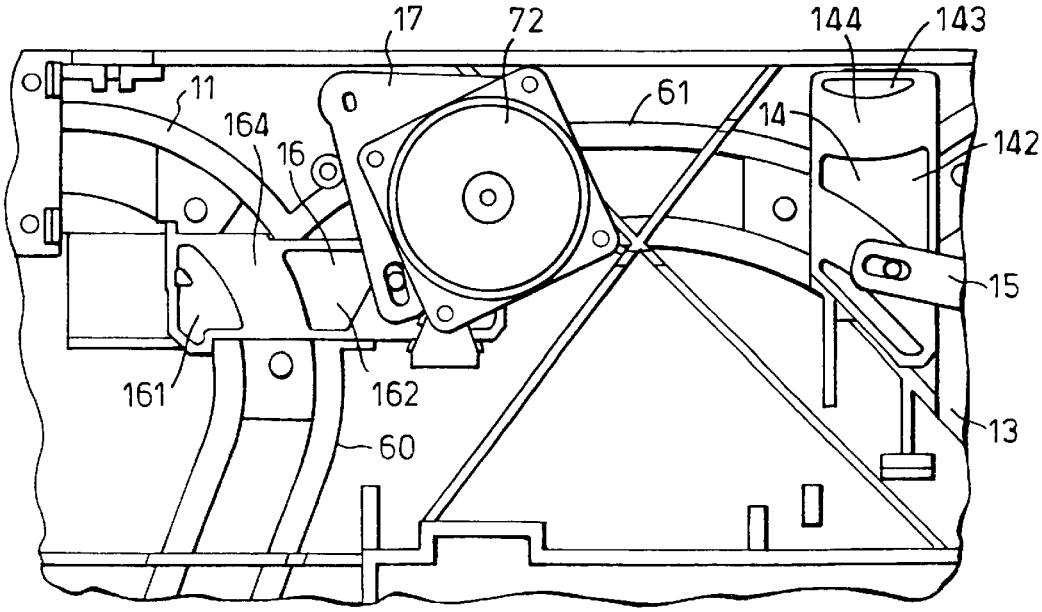
FIG. 3 is an external view of the same part as that shown in FIG. 2, but shows the selector slide in position for movement of the carriage to a dispensing station C, and a further selector slide in position for movement of the carriage to a reject station D.

The slide 16 is horizontally slidable on the chassis 1 and includes cog segments 161,162 which can be moved to either one of two positions 164,165 shown in FIGS. 3 and 2 respectively. The slide 16 is moved by an arm 17 by a motor 72 controlled by the processor.

Of course, a duplicate set of slides and racks is provided on the side plate 3, opposite slides being connected for simultaneous movement.

When the slide 16 is in the position shown at 164 (FIG. 3), the rack 60 is connected to the rack 11 and banknotes are transported to the dispensing station C. When the slide 16 has been moved to its other position 165 (FIG. 2) and the slide 14 is in the position 144, the racks 60,61 and 13 are connected and banknotes are transported to the reject station D and from there back to the banknote store, whereas when the slide 14 is in its other (upper) position 145, the racks 61,12 are connected and banknotes are transported to the dispensing station B on movement of the carriage 10.

Generally speaking, the number of path selection slides is one less than the number of stations provided in the arrangement.

Figure 4:
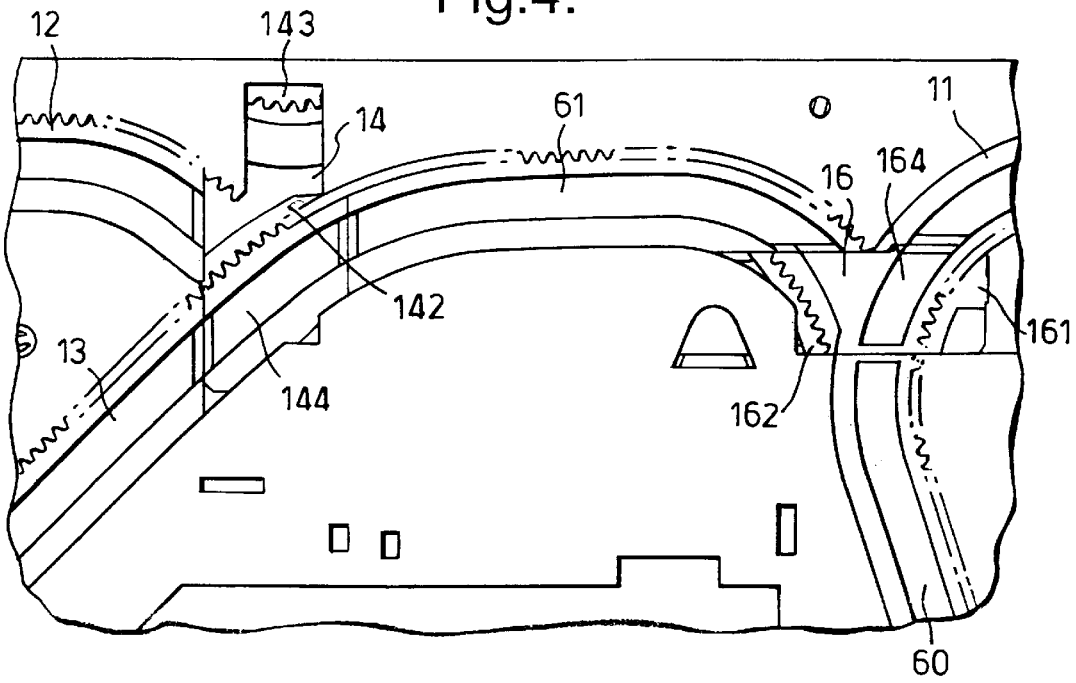
FIG. 4 is an inside view of the same part as that shown in FIGS. 2 and 3 and shows the selector slides in the same positions as that shown in FIG. 3.

FIG. 4 is an inside view of the same part as that shown in FIGS. 2 and 3 with the selection slides 14 and 16 in the same positions as those shown in FIG. 3.

Figure 5:
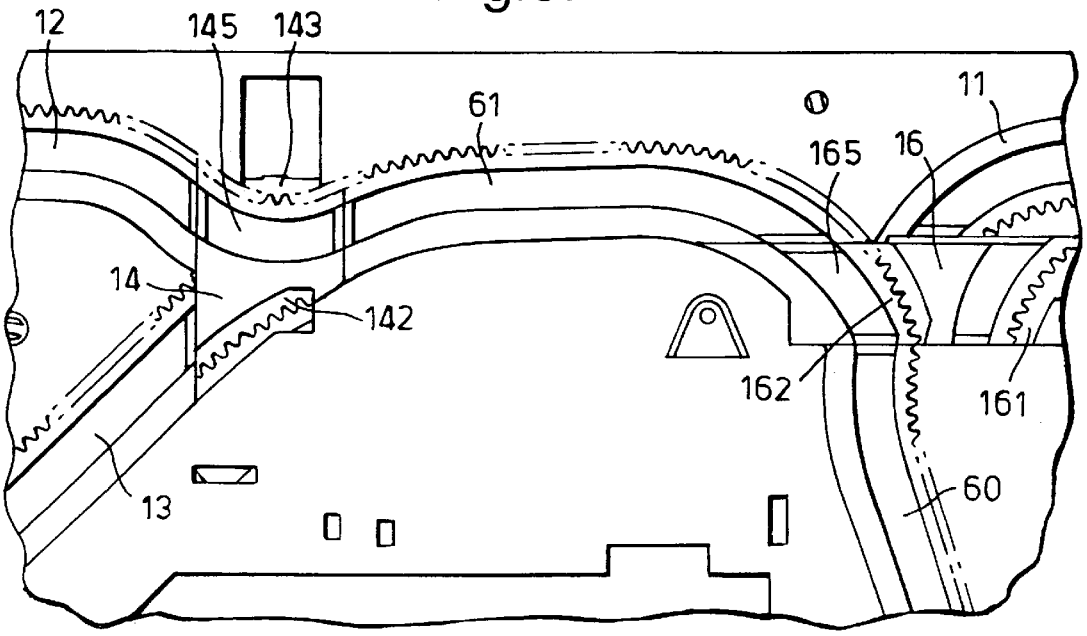
FIG. 5 is an inside view of the same part as that shown in FIG. 4, but shows the selector slides in position for transportation of banknotes to the dispensing station B; and, FIG. 6 is an enlarged view of part of one of the side walls of the chassis together with a driving cogwheel of the carriage.

FIG. 5 is an inside view of the same part as that shown in FIG. 4, but shows the path selection slide 14 in position 145 and the path selection slide 16 in position 165 for moving the carriage to the dispensing station B.

The carriage cogwheels 10A are driven in a conventional way from a motor 200 mounted to the carriage and controlled by the processor.

I claim:

1. Apparatus for feeding sheets from a sheet store to any one of a plurality of stations, the apparatus comprising a movable carriage for transporting sheets dispensed from the store and having driving cogwheels which coact with a generally fixed cog railway located outside the carriage, said cog railway having a number of sections on to which said carriage can be selectively guided so as to move it to a selected one of the stations, wherein said fixed cog railway includes at least one selector slide which is provided with cog segments that can be fitted into said cog railway and that can be switched to any one of at least two possible positions so as to connect selected sections of said cog railway and provide a substantially continuous cog path therebetween.

2. Apparatus according to claim 1, wherein said selector slide is provided at the junction between three sections of said cog railway, said slide being movable between two positions so that one of said three sections can be connected to either one of said other two sections.

3. Apparatus according to claim 1, wherein said fixed cog railway includes a plurality of path selection slides, the number of path selection slides being one less than the number of stations included in said plurality of stations.

4. Apparatus according to claim 1, wherein said at least one selector slide is controlled by means of a respective processor-controlled motor-driven arm.

5. Apparatus according to claim 1, further comprising a reject station, the sheet feeding apparatus enabling the carriage to be driven to said reject station from each dispensing station.

6. Banknote dispensing apparatus comprising a store; a pair of dispensing stations; and apparatus for transporting banknotes from said store to either of said dispensing stations, said apparatus including a movable carriage for transporting sheets dispensed from the store and having driving cogwheels which coact with a generally fixed cog railway located outside the carriage, said cog railway having a number of sections on to which said carriage can be selectively guided so as to move it to a selected one of the stations, wherein said fixed cog railway includes at least one selector slide which is provided with cog segments that can be fitted into said cog railway and that can be switched to any one of at least two possible positions so as to connect selected sections of said cog railway and provide a substantially continuous cog path therebetween.

7. Apparatus according to claim 1, further including a motor that is mounted on the movable carriage and that drives the cogwheels.

* * * * *